US005718501A

United States Patent [19]

White

[11] Patent Number: 5,718,501

[45] Date of Patent: Feb. 17, 1998

[54] RANGE BACKSPLASH ASSEMBLY

[75] Inventor: James Aaron White, Louisville, Ky.

[73] Assignee: General Electric Company, Louisville, Ky.

[21] Appl. No.: 541,385

[22] Filed: Oct. 10, 1995

[51] Int. Cl.[6] ..... F27D 21/02

[52] U.S. Cl. ..... 362/92; 362/26; 362/31

[58] Field of Search ..... 126/39 R; 362/23, 362/26, 29, 30, 92, 27, 31

[56] References Cited

U.S. PATENT DOCUMENTS

| | | | |
|---|---|---|---|
| 2,609,476 | 9/1952 | Ackemann | 362/92 X |
| 2,648,305 | 8/1953 | Appleman | 362/26 X |
| 2,711,475 | 6/1955 | Chadwick et al. | 362/92 |

*Primary Examiner*—Stephen F. Husar
*Attorney, Agent, or Firm*—H. Neil Houser

[57] ABSTRACT

A range has a housing with a cook top, including a plurality of surface cooking units and a backsplash assembly extending upward at the rear of the cooking top. The backsplash assembly includes end caps, with generally vertical front and rear walls extending therebetween and a top wall extending between the front and rear walls to define a control cavity. A display plate of light transparent material overlies the front wall and has an upper portion extending above the top wall. A lamp cover extends between the end caps and projects forward from the rear wall and overlaps the display plate to form a lamp cavity separate from the control cavity. A lamp is mounted in the lamp cavity and the upper portion of the display plate transmits light from the lamp outwardly to illuminate the surface cooking units. The top edge of the display plate is exposed to light from the lamp for edgewise illumination of the plate. The lamp cover is removable for servicing the lamp without exposing any controls in the control cavity.

10 Claims, 2 Drawing Sheets

Fig. 1
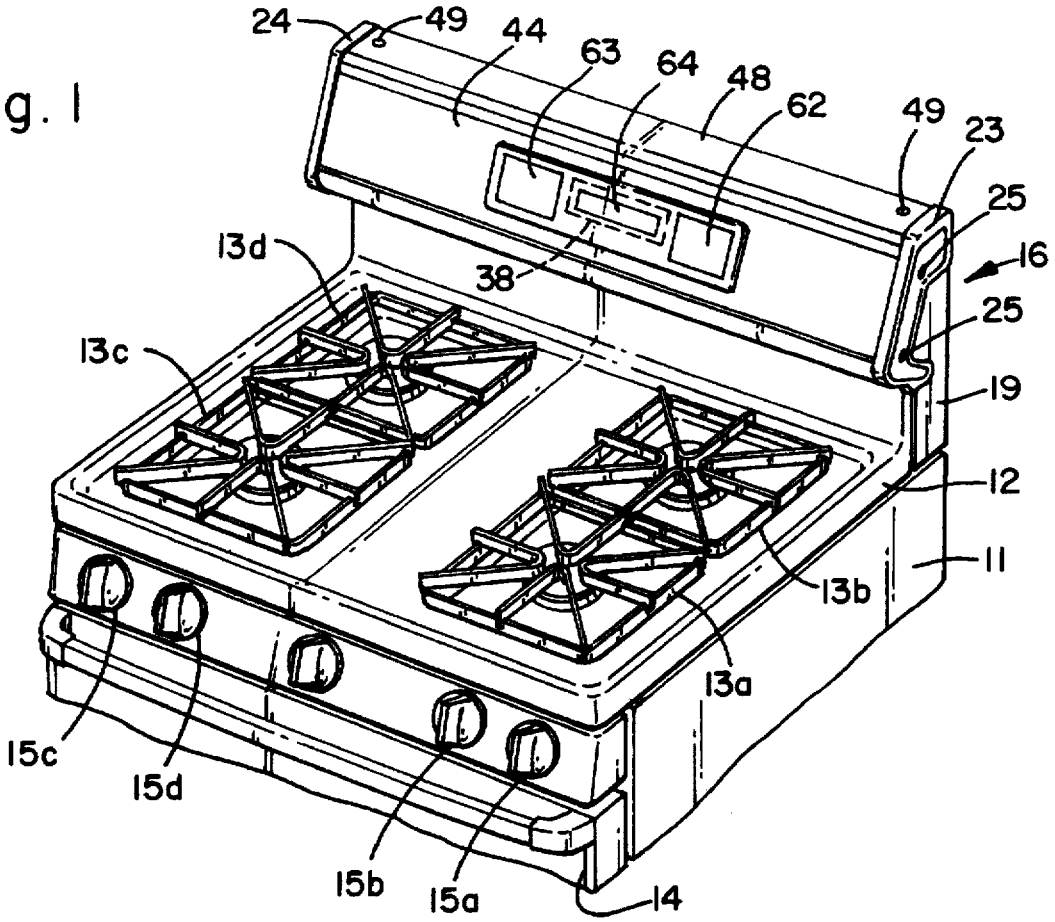
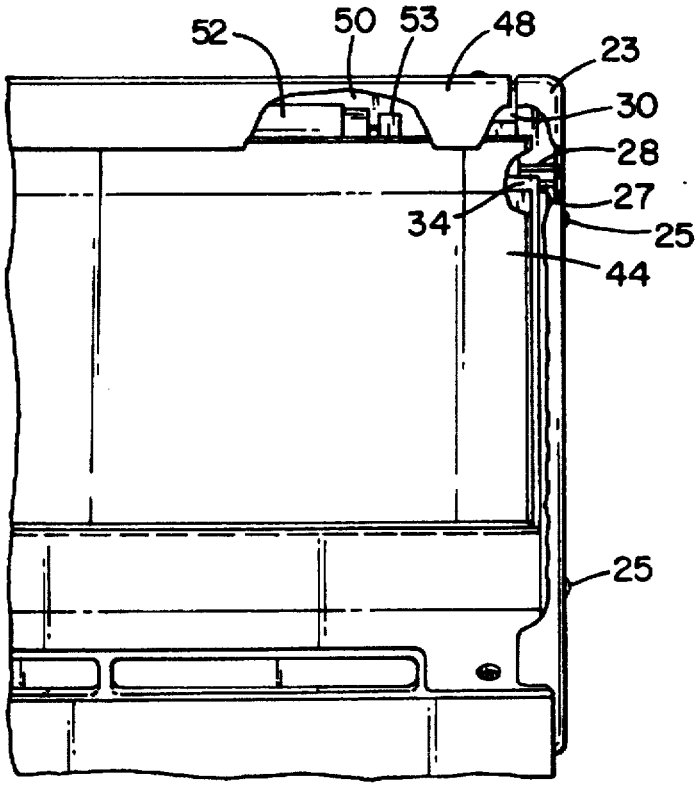
Fig. 2

RANGE BACKSPLASH ASSEMBLY

BACKGROUND OF THE INVENTION

The present invention relates to backsplash assemblies for cooking ranges and, more particularly, to such assemblies which include improved lighting arrangements.

Domestic cooking ranges normally include a backsplash assembly which projects upward of the surface cooking units at the rear of the range housing. Such assemblies have a number of uses. For example they often contain controls for operating the baking and broiling cavity or oven. Many times they also contain the controls for the various surface cooking units. In addition many such assemblies mount a lamp for illuminating the cook top. Some users like to use the lamp as a kitchen night light. Since steam and grease tend to rise from utensils used on the surface cooking units, it is desirable to enclose the lamp. One common approach is to include the lamp in the cavity formed in the backsplash assembly to hold the various operating controls. This presents a difficulty as the lamp tends to burn out much more often than any of the controls need service or replacement. In order not to be subject to a possible electrical shock from the controls, the person replacing a lamp must pull the range away from any adjacent wall and disconnect the range from the source of electric power. This is time consuming and unpleasant for the consumer and may require a service technician if the range is connected to a gas supply by non flexible pipe or tubing. In addition it is desirable that the various controls for the range be accessible from the front of the range for service or replacement.

It is an object of the present invention to provide a range including an improved backsplash assembly in which the illumination lamp is contained in a separate cavity accessible without exposing the range controls.

It is another object of this invention to provide such an improved assembly including a front display plate which protects the lamp from fumes and transmits light from the lamp outward to illuminate the surface cooking units.

It is yet another object of this invention to provide such an improved assembly in which the display is made of a light transparent material and is edge illuminated by the lamp.

It is still another object of this invention to provide such an improved assembly in which selected portions of the display plate are provided with decorative effects and/or are illuminated.

SUMMARY OF THE INVENTION

A range has a housing with a cook top, a plurality of surface cooking units carried by the cooking top and defining a surface cooking area and a backsplash assembly extending upward from the housing across the rear of the surface cooking area. The backsplash assembly includes a pair of spaced apart end caps extending upward of the housing on opposite sides of the surface cooking area. A generally vertical rear wall extends between the end caps and a generally vertical front wall extends between the end caps and is spaced in front of the rear wall. A top wall extends between the end caps, extends between the front and rear walls and is spaced above the housing to form a control cavity. Range controls are mounted in the control cavity. A display plate of light transparent material extends between the end caps and overlies the front wall. An upper portion of the display plate projects above the top wall. A lamp cover extends between the end caps, is spaced above the top wall and projects forward from the rear wall to overlap the upper end of the display plate to form a lamp cavity. A lamp is mounted in the lamp cavity and the upper portion of the display plate transmits light from the lamp outward to illuminate the surface cooking area. The top edge of the display plate is exposed to light from the lamp to edge illuminate the plate. The lamp cover is removable for service or replacement of the lamp without exposing the controls in the control cavity.

BRIEF DESCRIPTION OF THE DRAWINGS

FIG. 1 is a fragmentary front perspective view of the upper portion of a gas range with a backsplash assembly incorporating one embodiment of the present invention.

FIG. 2 is an enlarged fragmentary front elevation view of the right hand end portion of the backsplash assembly of FIG. 1, with the view being partly broken away for illustration.

DETAILED DESCRIPTION OF PREFERRED EMBODIMENT

Figure 3:
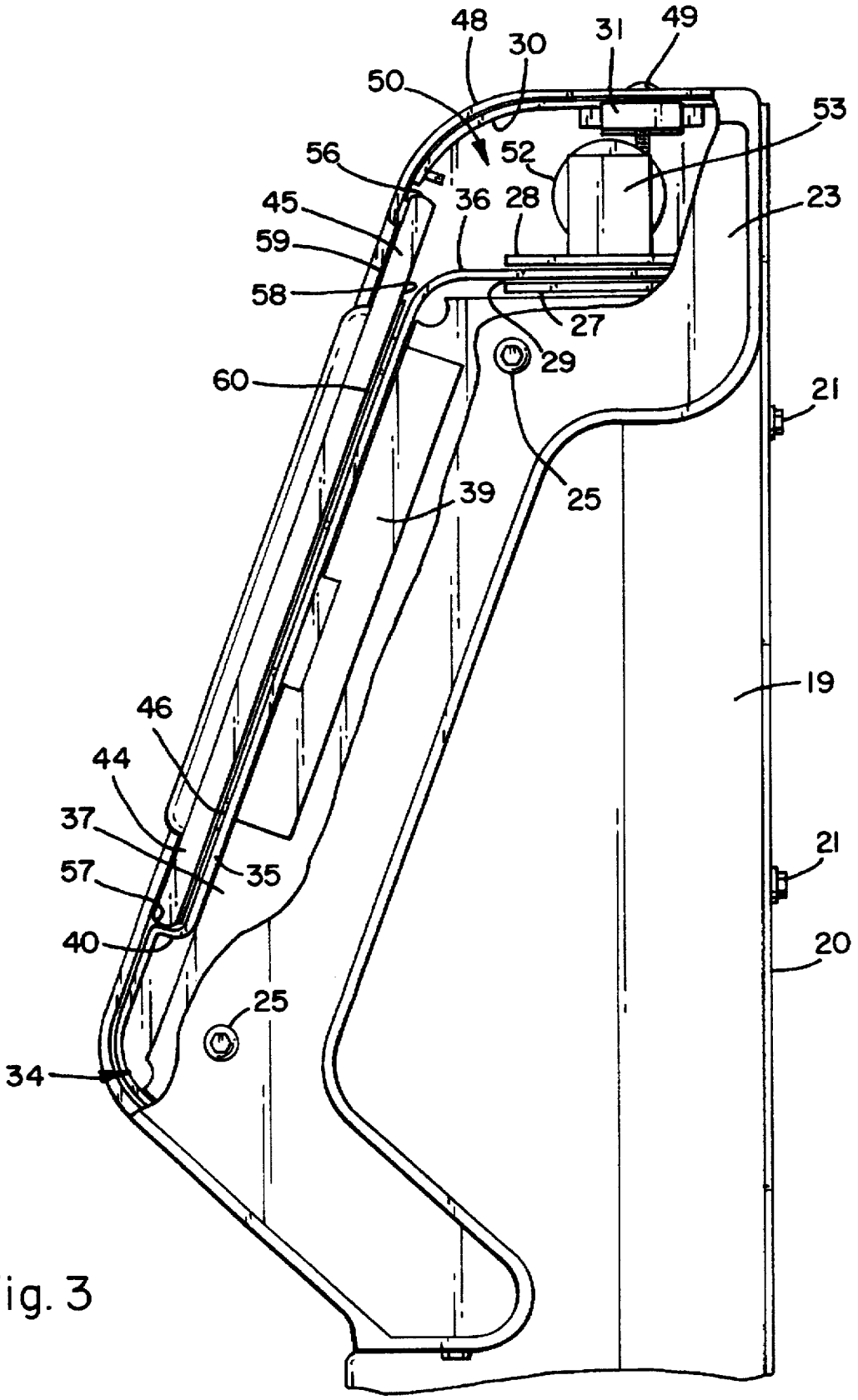
FIG. 3 is an enlarged right side elevation view of the backsplash assembly of FIG. 1, with the view being partly broken away for illustration.

Referring now to the drawings and, more particularly to FIG. 1, there is shown an illustrative free standing gas range 10. While a gas range is illustrated, it will be understood that the invention is equally applicable to electric ranges. The range 10 includes a box like housing 11 with a cooking top 12. Four surface cooking units 13*a*, 13*b*, 13*c* and 13*d* are mounted in the top 12. The area containing the units 13*a*–13*d* conveniently may be considered a surface cooking area. A cooking chamber or oven, not shown, is positioned within the housing 11 and access to the oven is provided by a drop down door 14. Each of the cooking units 13*a*–13*d* is provided with a valve to control the flow of gas to that unit and knobs 15*a*–15*d* enable the user to set the valves for the units 13*a*–13*d* respectively. A backsplash assembly 16 projects upward from the rear of the cook top 12 and extends substantially completely across the surface cooking area defined by units 13*a*–13*d*.

Referring now more particularly to FIGS. 2 and 3, the backsplash assembly 16 includes a bracket or support plate structurally attached to each upper rear corner of the housing by suitable means such as welding and providing support for the remainder of the assembly. One such bracket is shown at 19. A rear wall 20 projects upward from the back edge of the housing 11. The extends from one bracket 19 to the other and is connected to the brackets, as by screws 21. The rear wall 20 can be an extension the member forming the rear portion of the housing 11 or it can be a separate member.

A pair of end caps 23, 24 are removably mounted on the brackets 19 by suitable means such screws 25. Thus the end caps are laterally spaced apart across the housing 11 with each end cap preferably positioned just outward of the surface cooking area. It will be understood that the end caps are mirror images of each other and, for simplicity, only the right hand cap 23 will be described in detail. The inside of the cap 23 includes a pair of elongated, horizontal ribs 27, 28 which define an elongated horizontal recess 29 therebetween. A mounting ledge 30 is formed integrally with the top of the end cap 23 and includes an enlarged portion 31.

A control trim member 34 includes a generally vertical portion 35 which smoothly curves at its upper end into a horizontal portion 36. The member 34 extends between the end caps 23, 24 is mounted on the end caps by inserting the horizontal portion 36 in the recess 29 formed by the ribs 27–28 on the inside of each end cap. The generally vertical portion 35 forms the front wall and the horizontal portion 36 forms the top wall of a control cavity 37. The end caps form the end walls of the cavity 37 while rear wall 20 forms the rear of the cavity. It will be understood that, while the front portion 35 is generally vertical, it may be canted somewhat from true vertical to provide the backsplash with a swept back appearance. In the illustrative assembly the portion 35 is canted about fifteen degrees from true vertical. The portion 35 is cut away to define an opening therethrough generally as indicated by the broken line 38 in FIG. 1. Controls, such as a switch block 39, are mounted in the cavity 37 behind the opening 38. The portion 35 is stepped rearward below the opening 38 to form a ledge 40 that extends laterally across the trim member 34.

A generally planar display plate 44 is supported on the ledge 40 and extends from end cap 23 to end cap 24. The end caps overlap the plate and removably secure it in the backsplash assembly 16. If desired strips 46 of double sided adhesive tape can be applied along each lateral edge of the plate 44 to secure it to trim member 34 and prevent the plate 44 from rattling. The upper portion 45 of plate 44 projects above the top portion 36 of trim member 34 and terminates just below the front edge of mounting ledge 30. The display plate is formed of a light transparent material that will withstand the heat and vapors rising from the surface cooking units **13*a*–13*d*** and will not scratch when it is wiped off or cleaned. The presently preferred material is glass. Some plastic materials, such as some high temperature polycarbonates or acrylics with a scratch impervious coating for example, could be used; however, they currently are significantly more expensive than glass.

A lamp cover 48 extends between the end caps 23, 24 and is removably mounted on the mounting ledges 30 by suitable means such as screws 49 that pass through cover 48 and are threaded into the enlarged portions 31. If desired nuts may be imbedded in portions 31 and the screws replaced with small bolts so that the lamp cover can be removed repeatedly without the threaded fit of the fasteners 49 becoming loose. The lamp cover projects generally horizontally forward from the rear wall 20 and then curves downward to slightly overlap the top of display plate 44. This forms a lamp cavity 50 above the top portion 36 of trim member 34 and separate from the control cavity 37. A suitable lamp, such as an elongated fluorescent lamp 52, is mounted in cavity 50 by means of lamp holders 53 which are mounted to the top side of the trim member top portion 36 adjacent each end cap 23, 24. The lamp 52 can be replaced by merely removing lamp cover 48 and then replacing the cover once the new lamp is installed. As the controls in cavity 37 are not exposed when the cover 48 is removed there is no possibility of an electrical shock from contact with the controls. On the other hand, if it is desired to service a control in cavity 37, the lamp cover is removed and end caps 23–24 are removed. Then control trim member 34 is rotated forward and down to expose the controls.

Referring particularly to FIG. 3, the upper portion 45 of display plate 44 is exposed to light from lamp 52 when the lamp is energized. In the illustrative embodiment, upper plate portion 45 is light transparent and will transmit outward light from the lamp to provide maximum illumination of the cook top 12 and, particularly, the surface cooking units **13*a*–13*d*. It is not necessary that the lamp 48 be as long as the width of the cook top 12; however, it is desirable that the lamp extend substantially across the surface cooking area defined by units 13*a*–13*d* so as to fully illuminate the cooking area. It may be desirable to enable the user of the range to use the lamp 52 as a night light. In that event the upper portion 45 of plate 44 is made translucent to the light from lamp 52. This can be accomplished in a number of know ways. For example the surface of portion 45 toward lamp 52** could be frosted. Also dots of paint or similar opaque coating could be applied to the surface to provide a similar effect.

The top edge 56 of plate 44 is spaced below the lamp cover 48 so that some light from lamp 52 will impinge on the top edge. The plate 44 acts as a light pipe and transmits this light downward through the plate. The top edge 56 can be straight; however, as the preferred plate 44 is made of glass the edge 56 is ground or polished with a slight curvature. This enhances the light transmitting characteristics and eliminates sharp edges. Similarly, the bottom edge 57 is ground or polished with a slight curvature. The ledge 40, on which the bottom edge 57 rests, preferably is made light reflective. This will reflect light reaching the bottom of plate and cause a line or thin area of light to appear along the bottom plate 44 above the cooking units **13*a*–13*d***.

The display plate 44 includes a rear surface 58 that overlies the vertical portion 35 of control trim member 34 and a front surface 59 positioned above the cooking units and visible to users of the range. The rear surface 58 is covered with an opaque coating 60 which hides the trim member 34 and those items that would be visible through opening 38. Preferably the coating is the same color as housing 11 or is another color chosen for the control area. For example many current appliances have black control areas, regardless of the color of the appliance housing. Conveniently the coating can be applied to the surface 58 by some suitable process such as silk screening or it can be a separate member applied to surface 58 by adhesive.

The illustrative range includes "electronic" controls which have touchpad inputs and digital readouts. To that end three control elements on a single control assembly are mounted on the outside of plate 44 in register with the cutout 38 in trim member 34. Referring to FIG. 1, a touchpad 63 provides inputs for the oven control part of switch block 39; touchpad 62 provides input for a clock/timer part of switch block 39 and pad 64 provides a digital readout from the clock/timer. As is known in the art, plate 44 is provided with a small slot (not shown) for leads (not shown) for making electrical connections through the plate. If desired decorative indicia, such as the manufacturer's logo or the model name of the range for example, can be applied to the inner surface 58 under the coating 60 in desired areas, such as in register with cutout 38. Such indicia would be of a color that contrasts with the color of the coating 60. Also if desired the plate 44 can be treated in a manner known in the art so that desired areas are illuminated. Assuming it is desired to illuminate area 38, the inner surface 58 in that area of plate 44 could be roughened as by etching or by forming ribs therein so that some of the light being transmitted downward through plate 44 will be reflected and exit through the front surface 59. Also the thickness of plate 44 could be reduced at a selected area to cause some of the light to exit through the front surface.

While specific embodiments of the invention have been illustrated and described herein, it is realized that modifications and changes will occur to those skilled in the art to which the invention pertains. It is therefore to be understood that the appended claims are intended to cover all such modifications and changes as fall within the true spirit and scope of the invention.

What is claimed is:

1. In a range having a housing with a cooking top, a plurality of surface heating units carried by the cooking top and defining a surface cooking area; a backsplash assembly extending upward from the housing across the rear of the cooking area and including:

a pair of spaced apart end caps extending upward from the housing on opposite sides of the surface cooking area; an upwardly projecting rear wall extending between said end caps; an upwardly projecting front wall extending between said end caps and spaced forward of said rear wall; and a top wall extending between said end caps, extending between said front and rear walls and spaced above the cooking top to define therein a control cavity;

said front wall defining an opening therein;

controls for the range mounted in said control cavity behind said opening in said front wall;

a display plate of light transparent material extending between said end caps, overlying said front wall and covering said opening, said plate including an upper portion projecting above said top wall;

a lamp cover extending between said end caps, spaced above said top wall, extending forward of said rear wall and overlapping the top of said display plate to form a lamp cavity separate from said control cavity;

an electrically energizable lamp mounted in said lamp cavity;

said upper portion of said display plate transmitting light from said lamp outwardly of said lamp cavity to illuminate the cooking area when said lamp is energized; and said upper portion of said display plate defining a top edge exposed to said lamp for edgewise illumination of said plate when said lamp is energized.

2. A range backsplash assembly as set forth in claim 1, wherein; said upper portion of said display plate is translucent so that said lamp may serve as a night light.

3. A backsplash assembly as set forth in claim 1, wherein: said top edge of said display plate is ground with a curved surface.

4. A backsplash assembly as set forth in claim 1, further including: connectors removably mounting said lamp cover in said backsplash assembly so that said lamp can be serviced without exposing said controls in said control cavity.

5. A backsplash assembly as set forth in claim 1, wherein:

said front wall includes a rearward projecting ledge extending between said end caps and spaced below said top wall; and said display plate including a bottom edge resting on said ledge;

said ledge reflecting light transmitted from said display plate top edge so that there is a lighted area across the bottom portion of said plate when said lamp is energized.

6. A backsplash assembly as set forth in claim 5 wherein: said bottom edge of said display plate is ground with a curved surface.

7. A backsplash assembly as set forth in claim 1, further including; connectors removably mounting said end caps to the housing so that said controls can be serviced from the front of the range.

8. A backsplash assembly as set forth in claim 1, wherein:

said display plate includes a rear surface overlying said front wall and a front surface positioned above the surface cooking area;

an opaque coating applied to said rear surface provides a pleasing appearance through said front surface.

9. A backsplash assembly as set forth in claim 8, wherein: at least one decorative element, contrasting to said opaque coating, is applied to said rear surface in the area of said display plate covering said opening in said front wall.

10. A backsplash assembly as set forth in claim 8, wherein: said rear surface is treated to reflect light through said front surface in the area of said display plate covering said opening in said front wall.

* * * * *